US008505987B2

(12) United States Patent
Browne et al.

(10) Patent No.: US 8,505,987 B2
(45) Date of Patent: Aug. 13, 2013

(54) ELECTRICALLY-ACTIVATED HOOD LATCH AND RELEASE MECHANISM

(75) Inventors: Alan L. Browne, Grosse Pointe, MI (US); Nancy L. Johnson, Northville, MI (US); David M. Connor, Grand Blanc, MI (US); James Holbrook Brown, Costa Mesa, CA (US)

(73) Assignees: GM Global Technology Operations LLC, Detroit, MI (US); Dynalloy, Inc., Costa Mesa, CA (US)

( * ) Notice: Subject to any disclaimer, the term of this patent is extended or adjusted under 35 U.S.C. 154(b) by 534 days.

(21) Appl. No.: 12/607,143

(22) Filed: Oct. 28, 2009

(65) Prior Publication Data

US 2010/0237632 A1 Sep. 23, 2010

Related U.S. Application Data

(60) Provisional application No. 61/160,847, filed on Mar. 17, 2009.

(51) Int. Cl.
*E05C 3/06* (2006.01)

(52) U.S. Cl.
USPC ..... 292/201; 292/216

(58) Field of Classification Search
USPC ..... 292/201, 216, 336.3, 144
See application file for complete search history.

(56) References Cited

U.S. PATENT DOCUMENTS 4,489,904 A * 12/1984 Soederberg ..... 244/99.3
5,497,641 A * 3/1996 Linde et al. ..... 70/257
5,537,848 A * 7/1996 Grzanka et al. ..... 70/279.1
5,682,135 A * 10/1997 Labonde ..... 340/426.17
5,887,466 A * 3/1999 Yoshizawa ..... 70/257
5,987,818 A * 11/1999 Dabideen ..... 49/280
6,002,341 A * 12/1999 Ohta et al. ..... 340/5.62
6,053,543 A * 4/2000 Arabia et al. ..... 292/201
6,065,316 A * 5/2000 Sato et al. ..... 70/264
6,367,296 B1 * 4/2002 Dupont ..... 70/257
6,575,003 B1 * 6/2003 Dupont ..... 70/257
6,598,436 B2 * 7/2003 Ponn et al. ..... 70/256
6,648,380 B1 * 11/2003 Szablewski et al. ..... 292/201
6,824,177 B1 * 11/2004 Nass et al. ..... 292/216
6,886,869 B2 * 5/2005 Martinez et al. ..... 292/216
7,070,213 B2 * 7/2006 Willats et al. ..... 292/216
7,119,663 B2 * 10/2006 Katagiri et al. ..... 340/5.72
7,210,713 B2 * 5/2007 Yoshida et al. ..... 292/201
7,819,440 B2 * 10/2010 Schwickerath ..... 292/201
2002/0096890 A1 * 7/2002 Cetnar et al. ..... 292/201
2005/0206173 A1 * 9/2005 Lim ..... 292/216
2008/0217927 A1 9/2008 Browne et al.

* cited by examiner

*Primary Examiner* — Thomas A Beach
*Assistant Examiner* — Mark Williams
(74) *Attorney, Agent, or Firm* — Quinn Law Group, PLLC

(57) ABSTRACT

A latch assembly includes a latch movable between released and restrained positions and a latch spring biasing toward the released position. A first lever is movable between open and closed positions, corresponding to the released and restrained positions, respectively. A first lever spring biases toward the closed position. A second lever is movable between unlocked and locked positions, corresponding to the first lever open and closed positions, respectively. A second lever spring biases toward the locked position. An active material based actuator selectively moves the second lever from the locked to unlocked position in response to an activation signal. A primary activation mechanism selectively produces the activation signal without a mechanical connection to the passenger compartment. An auxiliary activation mechanism does not rely on the vehicle power system. A key or portable energy storage device may cause the activation signal from the primary or auxiliary activation mechanism.

18 Claims, 6 Drawing Sheets

ELECTRICALLY-ACTIVATED HOOD LATCH AND RELEASE MECHANISM

CROSS-REFERENCE TO RELATED APPLICATIONS

This application claims the benefit of U.S. Provisional Application No. 61/160,847, filed Mar. 17, 2009, which is hereby incorporated by reference in its entirety.

TECHNICAL FIELD

This disclosure relates generally to latch assemblies or mechanisms for performing such functions as hood release.

BACKGROUND OF THE INVENTION

Vehicle hood release systems for vehicles typically include a hand lever or pull handle attached to a cable that is cooperatively used to release the hood, cowling, or bonnet. Cable operation generally requires a physical action on the part of the vehicle operator, e.g., pulling of a handle or lever.

The cables employed for these types of systems may be formed from steel of a fixed length and are coupled to a mechanism that causes the hood to be released from an underlying structure. These systems may require manual activation from within the passenger compartment of the vehicle. Vehicles may also be equipped with a secondary mechanism, such that both the primary and secondary mechanisms need to be released before the hood can be fully opened or lifted away from the vehicle.

SUMMARY

A latch assembly for a vehicle is provided. The latch assembly includes a latch movable between a released position and a restrained position, and a latch spring operatively attached to the latch and configured to bias the latch toward the released position. A first lever is mounted with respect to the latch and movable between an open position and a closed position. The released position of the latch corresponds to the open position of the first lever, and the restrained position of the latch corresponds to the closed position of the first lever. A first lever spring is operatively attached to the first lever and is configured to bias the first lever toward the closed position.

A second lever is mounted with respect to the first lever and is movable between an unlocked and a locked position. The unlocked position of the second lever corresponds to the open position of the first lever, and the locked position of the second lever corresponds to the closed position of the first lever. A second lever spring is operatively attached to the second lever and is configured to bias the second lever toward the locked position.

An active material based actuator is operatively connected to the second lever and is configured to selectively move the second lever from the locked position to the unlocked position when the active material based actuator is subjected to an activation signal. A primary activation mechanism is operatively connected to a power system of the vehicle and is configured to selectively produce the activation signal for the active material based actuator.

The latch assembly may include an auxiliary activation mechanism, which is configured to selectively move the second lever from the locked position to the unlocked position. The auxiliary activation mechanism does not rely on the power system. A trigger device may be operatively connected to the primary activation mechanism and configured to cause the primary activation mechanism to produce the activation signal. The trigger device may be located or placed in the passenger compartment but is characterized by lack of a mechanical connection to the passenger compartment.

The activation signal may be an electrical current passing through the active material based actuator. The active material based actuator may be a shape memory alloy (SMA) wire.

The auxiliary activation mechanism may include a dedicated energy storage device configured to selectively produce the activation signal. A key may be operatively connectable to the auxiliary activation mechanism and configured to cause the auxiliary activation mechanism to produce the activation signal. The key may further include a portable energy storage device configured to selectively produce the activation signal. Alternatively, the auxiliary activation mechanism may be a mechanical actuator configured to selectively, mechanically move the second lever from the locked position to the unlocked position.

The latch assembly may further include a first cam portion on the first lever and a second cam portion on the latch. The first and second cam portions cooperate to prevent movement of the second lever into the closed position unless and until the latch is fully in the restrained position.

The latch assembly may further include a portable trigger mechanism configured to cause either the primary or auxiliary activation mechanism to produce the activation signal. The portable trigger mechanism is not fixed to the passenger compartment, and may be the sole mechanism configured to cause the activation signal.

The above features and advantages and other features and advantages of the present invention are readily apparent from the following detailed description of the best modes and other embodiments for carrying out the invention when taken in connection with the accompanying drawings.

DESCRIPTION OF PREFERRED EMBODIMENTS

Figure 1:
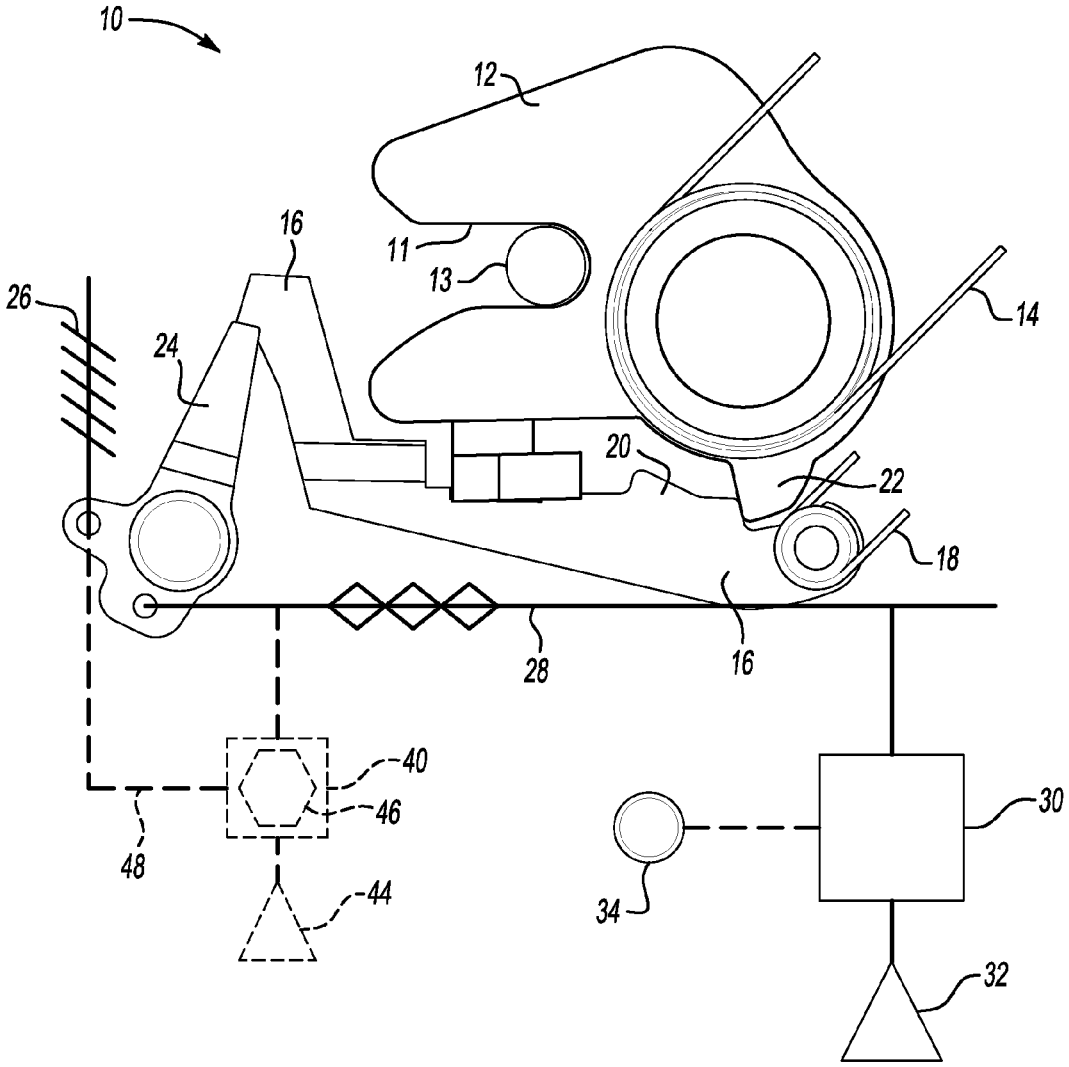
FIG. 1 is a schematic side view of a latch assembly usable as a hood latch and release, shown in a locked position configured to restrain the hood tightly to the vehicle.
Figure 2:
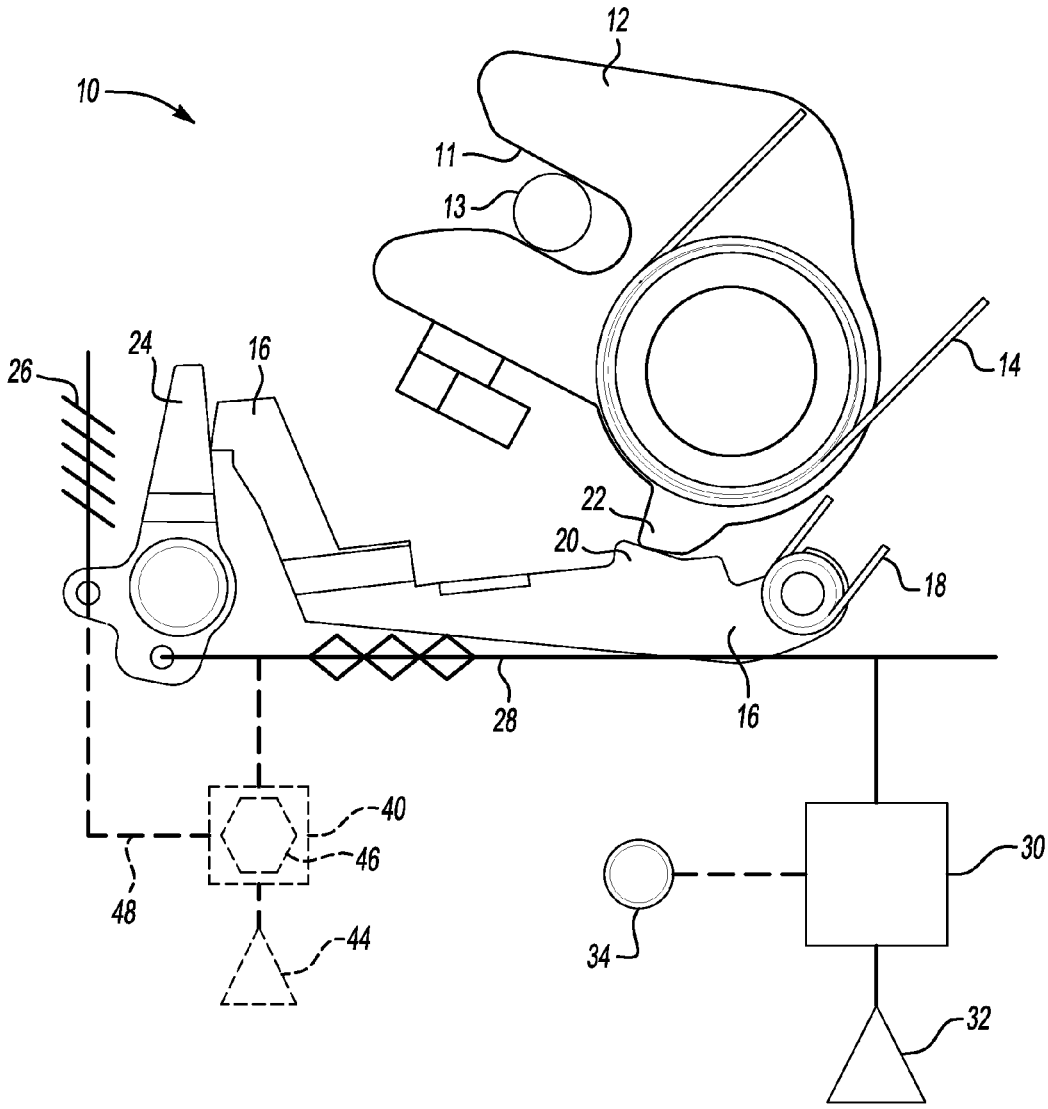
FIG. 2 is a schematic side view of the latch assembly shown in FIG. 1, showing the latch assembly in a partially-released position.
Figure 3:
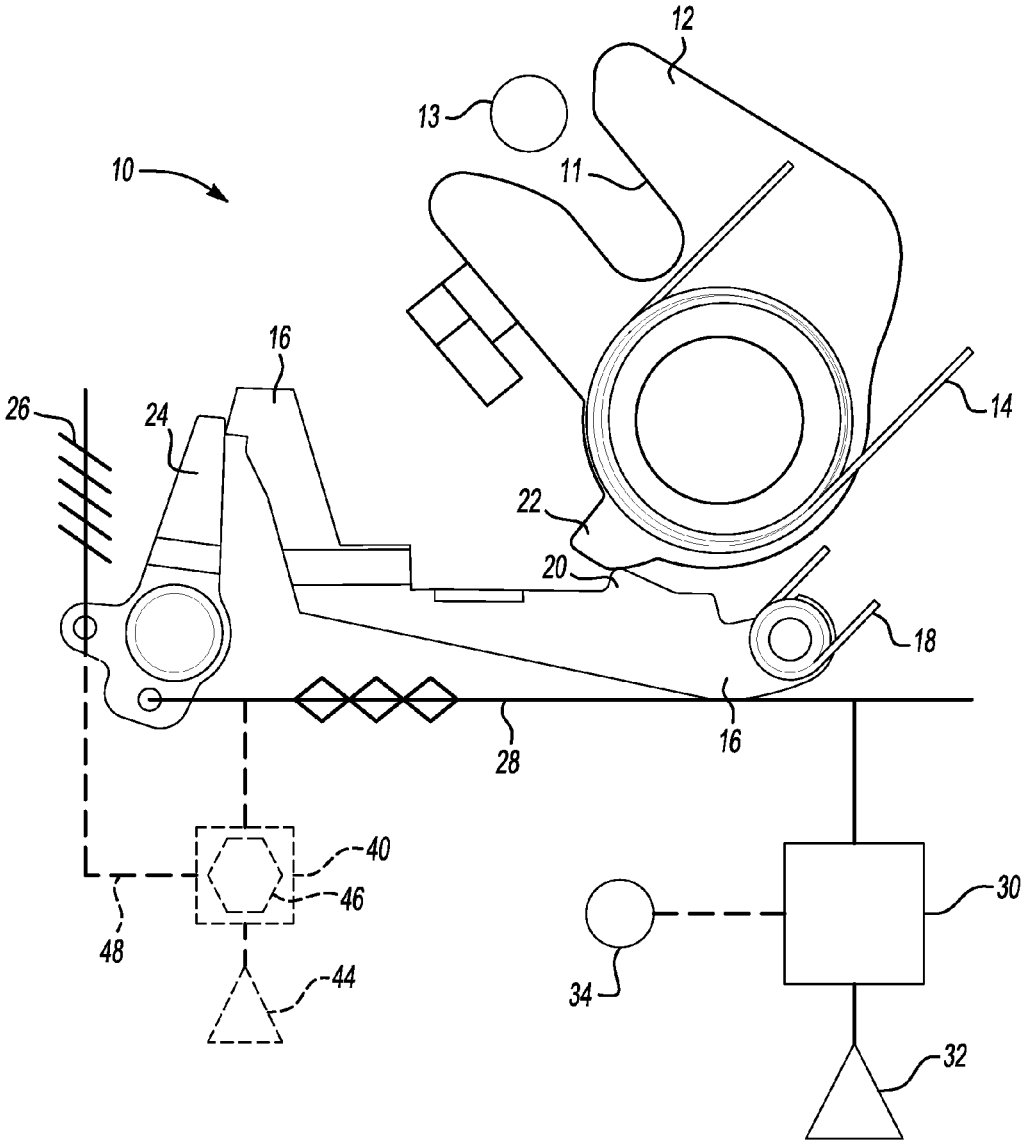
FIG. 3 is a schematic side view of the latch assembly shown in FIGS. 1 and 2, showing the latch assembly in a fully-released position, which allows the hood to be pulled away from the latch assembly.

Referring to the drawings, wherein like reference numbers correspond to like or similar components throughout the several figures, there is shown in FIGS. 1-3 a latch assembly 10 for a vehicle (not shown). The latch assembly 10 may be used as a hood latch configured to selectively hold and release (as described herein) a hood, cowling, or bonnet (not shown) of the vehicle. The latch assembly 10 may be used as a primary latch and coupled with a manual secondary latch mechanism, such that both latches need to be released before the hood can be fully opened or lifted away from the vehicle.

FIG. 1 shows the latch assembly 10 in a completely restrained position which completely prevents or restrains the vehicle hood from opening. FIG. 2 shows the latch assembly 10 in a mid-release position, in which the hood is loose but has not yet been released. FIG. 3 shows the latch assembly 10 in a released or open position, in which the hood is free to be raised away (typically upward) from the vehicle, possibly subject to release of the manual secondary latch. Those having ordinary skill in the art will recognize that the individual elements of the schematic drawings may not be to scale relative to each other, and the drawings may not be to scale relative to each other.

A latch 12 has a slot or gate 11 which is configured to restrain movement of a striker bar 13 which is rigidly attached to the hood. Latch 12 is movable between a released position and a restrained position. The restrained position is shown in FIG. 1 and represents complete restraint of the striker bar 13, such that the hood is securely pulled to the vehicle and cannot be opened. The released position of latch 12 may be considered to encompass all positions, rotations, or movements beyond the restrained position. FIGS. 2 and 3 show latch 12 in the released position, such that the striker bar 13 is either moveable within the gate 11 (as shown in FIG. 2) and therefore allows some movement of the hood relative to the vehicle, or is free to be removed from the gate 11 (upward, as shown in FIG. 3).

A latch spring 14 is operatively attached to the latch 12 and to a housing (not shown) which is rigidly attached or affixed to the vehicle. Latch spring 14 is configured to bias the latch 12 toward the released position (a clockwise bias, as shown in FIGS. 1-3). In the latch assembly 10 shown in FIGS. 1-3, latch spring 14 is a torsion spring. However, a linear-type (compression or tension) spring may also be used.

A first lever 16 is mounted with respect to the latch 12 and movable between an open position and a closed position. The closed position of the first lever 16 is shown in FIG. 1 and the open position is shown in FIGS. 2 and 3.

A first lever spring 18 is operatively attached to the first lever 16 and to the housing (not shown). First lever spring 18 is configured to bias the first lever 16 toward the closed position (clockwise, as shown in FIGS. 1-3). In the latch assembly 10 shown in FIGS. 1-3, first lever spring 18 is a torsion spring. However, a linear-type (compression or tension) spring may also be used.

First lever 16 interfaces with latch 12 to limit relative movement between latch 12 and first lever 16. The released position of the latch 12 corresponds to the open position of first lever 16, and the restrained position of the latch 12 corresponds to the closed position of first lever 16.

First lever 16 includes first cam portion 20 and the latch 12 includes a second cam portion 22. The first and second cam portions 20 and 22 cooperate to prevent movement of the first lever 16 into the closed position unless the latch 12 is fully in the restrained position. The first and second cam portions 20 and 22 also provide a friction interface between the latch 12 and first lever 16, which limits relative movement of the latch 12 and first lever 16. The friction between the first and second cam portions 20 and 22 may be tuned to control the force required to move the latch 12 from the restrained to the released position.

A second lever 24 is mounted with respect to the first lever and movable between an unlocked and a locked position. The locked position of the second lever 24 is shown in FIG. 1 and the unlocked position is shown in FIGS. 2 and 3.

Second lever 24 interfaces with first lever 16 to limit relative movement between second lever 24 and first lever 16. The unlocked position of second lever 24 corresponds to the open position of first lever 16, and the locked position of second lever 24 corresponds to the closed position of first lever 16.

A second lever spring 26 is operatively attached to the second lever 24 and to the housing (not shown). Second lever spring 26 is configured to bias the second lever 24 toward the locked position (clockwise, as shown in FIGS. 1-3). In the latch assembly 10 shown in FIGS. 1-3, second lever spring 26 is a linear tension spring. However, a torsion spring may also be used.

Operation of latch assembly 10 is effected by an active material based actuator 28, which is operatively connected to the second lever 24 and to the housing (not shown). The active material based actuator 28 is configured to selectively move the second lever 24 from the locked position to the unlocked position in the presence of an activation signal, as described herein.

Active materials include those compositions that can exhibit a change in stiffness properties, shape and/or dimensions in response to an activation signal, which can be an electrical, magnetic, thermal or a like field depending on the different types of active materials. Preferred active materials include but are not limited to the class of shape memory materials, and combinations thereof. Shape memory materials, also sometimes referred to as smart materials, refer to materials or compositions that have the ability to remember their original shape, which can subsequently be recalled by applying an external stimulus (i.e., an activation signal). As such, deformation of the shape memory material from the original shape can be a temporary condition.

Exemplary shape memory materials include shape memory alloys (SMAs), electroactive polymers (EAPs) such as dielectric elastomers, piezoelectric polymers, magnetic shape memory alloys (MSMA), shape memory ceramics (SMCs), baroplastics, paraffin wax, piezoelectric ceramics, magnetorheological (MR) elastomers, ferromagnetic SMAs, electrorheological (ER) elastomers, and the like, composites of the foregoing shape memory materials with non-shape memory materials, and combinations comprising at least one of the foregoing shape memory materials. For convenience and by way of example, reference herein will be made to shape memory alloys. Electroactive polymers, shape memory ceramics, baroplastics, and the like can be employed in a similar manner as will be appreciated by those skilled in the art in view of this disclosure. For example, with baroplastic materials, a pressure induced mixing of nanophase domains of high and low glass transition temperature (Tg) components affects the shape change. Baroplastics can be processed at relatively low temperatures repeatedly without degradation. SMCs are similar to SMAs but can tolerate much higher operating temperatures than can other shape-memory materials. An example of an SMC is a piezoelectric material.

The ability of shape memory materials to return to their original shape upon the application of external stimuli allows for their use in actuators to apply force resulting in desired motion. Smart material actuators offer the potential for a reduction in actuator size, weight, volume, cost, noise and an increase in robustness in comparison with traditional electromechanical and hydraulic means of actuation.

SMA: Shape memory alloys (SMAs) are alloy compositions with at least two different temperature-dependent phases. The most commonly utilized of these phases are the so-called martensite and austenite phases. In the following discussion, the martensite phase generally refers to the more deformable, lower temperature phase whereas the austenite phase generally refers to the more rigid, higher temperature phase. When the shape memory alloy is in the martensite phase and is heated (e.g., activated by resistive heating), it begins to change (i.e., actuate) into the austenite phase. The temperature at which this phenomenon starts is often referred to as austenite start temperature (As). The temperature at which this phenomenon is complete is often called the austenite finish temperature (Af). When the shape memory alloy is in the austenite phase and is cooled (e.g., by terminating the resistive heating, therefore allowing cooling to ambient temperature), it begins to change into the martensite phase, and the temperature at which this phenomenon starts is often referred to as the martensite start temperature (Ms). The temperature at which austenite finishes transforming to martensite is often called the martensite finish temperature (Mf). The range between As and Af is often referred to as the martensite-to-austenite transformation temperature range while that between Ms and Mf is often called the austenite-to-martensite transformation temperature range. It should be noted that the above-mentioned transition temperatures are functions of the stress experienced by the SMA sample. Generally, these temperatures increase with increasing stress. In view of the foregoing properties, deformation of the shape memory alloy is preferably at or below the austenite start temperature (at or below As). Subsequent heating (activating) above the austenite start temperature causes the deformed shape memory material sample to begin to revert back (i.e., actuate) to its original (nonstressed) permanent shape until completion at the austenite finish temperature. Thus, a suitable activation input or signal for use with shape memory alloys is a thermal activation signal having a magnitude that is sufficient to cause transformations between the martensite and austenite phases.

The temperature at which the shape memory alloy remembers its high temperature form (i.e., its original, nonstressed shape) when heated can be adjusted by slight changes in the composition of the alloy and through thermo-mechanical processing. In nickel-titanium shape memory alloys, for example, it can be changed from above about 100 degrees Celsius to below about −100 degrees Celsius. The shape recovery process can occur over a range of just a few degrees or exhibit a more gradual recovery over a wider temperature range. The start or finish of the transformation can be controlled to within several degrees depending on the desired application and alloy composition. The mechanical properties of the shape memory alloy vary greatly over the temperature range spanning their transformation, typically providing shape memory effect and superelastic effect. For example, in the martensite phase a lower elastic modulus than in the austenite phase is observed. Shape memory alloys in the martensite phase can undergo large deformations by realigning the crystal structure arrangement with the applied stress. As will be described in greater detail below, the material will retain this shape after the stress is removed.

Suitable shape memory alloy materials include, but are not intended to be limited to, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-palladium based alloys, and the like. The alloys can be binary, ternary, or any higher order so long as the alloy composition exhibits a shape memory effect, e.g., change in shape, orientation, yield strength, flexural modulus, damping capacity, superelasticity, and/or similar properties. Selection of a suitable shape memory alloy composition depends, in part, on the temperature range of the intended application.

The recovery to the austenite phase at a higher temperature is accompanied by very large (compared to that needed to deform the material) stresses (i.e., resulting actuation forces) which can be as high as the inherent yield strength of the austenite material, sometimes up to three or more times that of the deformed martensite phase. For applications that require a large number of operating cycles, a strain in the range of up to 4% of the deformed length of wire used can be obtained. In experiments performed with FLEXINOL® wires of 0.5 mm diameter, the maximum strain for large cycle number operation on the order of 4% was obtained. This percentage can increase up to 8% for applications with a low number of cycles.

EAPS: The active material may also comprise an electroactive polymer such as conductive polymers, piezoelectric polymeric material and the like. As used herein, the term "piezoelectric" is used to describe a material that mechanically deforms when a voltage potential is applied, or conversely, generates an electrical charge when mechanically deformed Electroactive polymers include those polymeric materials that exhibit piezoelectric, pyroelectric, or electrostrictive properties in response to electrical or mechanical fields. The materials generally employ the use of compliant electrodes that enable polymer films to expand or contract in the in-plane directions in response to applied electric fields or mechanical stresses. An example of an electrostrictive-grafted elastomer is a piezoelectric poly(vinyldene fluoride-trifluoro-ethylene) copolymer. This combination has the ability to produce a varied amount of ferroelectric-electrostrictive molecular composite systems. These may be operated as a piezoelectric sensor or even an electrostrictive actuator.

Materials suitable for use as an electroactive polymer may include any substantially insulating polymer or rubber (or combination thereof) that deforms in response to an electrostatic force or whose deformation results in a change in electric field. Exemplary materials suitable for use as a pre-strained polymer include silicone elastomers, acrylic elastomers, polyurethanes, thermoplastic elastomers, copolymers comprising PVDF, pressure-sensitive adhesives, fluoroelastomers, polymers comprising silicone and acrylic moieties, and the like. Polymers comprising silicone and acrylic moieties may include copolymers comprising silicone and acrylic moieties, polymer blends comprising a silicone elastomer and an acrylic elastomer, for example.

Materials used for electrodes of the present disclosure may vary. Suitable materials used in an electrode may include graphite, carbon black, colloidal suspension, thin metals including silver and gold, silver filled and carbon filled gels and polymers, and ionically or electronically conductive polymers. It is understood that certain electrode materials may work well with particular polymers and may not work as well for others. By way of example, carbon fibrils work well with acrylic elastomer polymers while not as well with silicone polymers.

SMCs/Piezoelectric Materials: The active material may also comprise a piezoelectric material. As used herein, the term "piezoelectric" is used to describe a material that mechanically deforms (changes shape) when a voltage potential is applied, or conversely, generates an electrical charge when mechanically deformed. Preferably, a piezoelectric material is disposed on strips of a flexible metal or ceramic sheet. The strips can be unimorph or bimorph. Preferably, the strips are bimorph, because bimorphs generally exhibit more displacement than unimorphs.

One type of unimorph is a structure composed of a single piezoelectric element externally bonded to a flexible metal foil or strip, which is stimulated by the piezoelectric element when activated with a changing voltage and results in an axial buckling or deflection as it opposes the movement of the piezoelectric element. The actuator movement for a unimorph can be by contraction or expansion. Unimorphs can exhibit a strain of as high as about 10%, but generally can only sustain low loads relative to the overall dimensions of the unimorph structure. In contrast to the unimorph piezoelectric device, a bimorph device includes an intermediate flexible metal foil sandwiched between two piezoelectric elements. Bimorphs exhibit more displacement than unimorphs because under the applied voltage one ceramic element will contract while the other expands. Bimorphs can exhibit strains up to about 20%, but similar to unimorphs, generally cannot sustain high loads relative to the overall dimensions of the unimorph structure.

Suitable piezoelectric materials include inorganic compounds, organic compounds, and metals. With regard to organic materials, all of the polymeric materials with noncentrosymmetric structure and large dipole moment group(s) on the main chain or on the side-chain, or on both chains within the molecules, can be used as candidates for the piezoelectric film. Examples of suitable polymers include, for example, but are not limited to, poly(sodium 4-styrenesulfonate) ("PSS"), poly S-119 (Poly(vinylamine) backbone azo chromophore), and their derivatives; polyfluorocarbines, including polyvinylidene fluoride ("PVDF"), its co-polymer vinylidene fluoride ("VDF"), trifluorethylene (TrFE), and their derivatives; polychlorocarbons, including poly(vinylchloride) ("PVC"), polyvinylidene chloride ("PVC2"), and their derivatives; polyacrylonitriles ("PAN"), and their derivatives; polycarboxylic acids, including poly (metharcylic acid ("PMA"), and their derivatives; polyureas, and their derivatives; polyerethanes ("PUE"), and their derivatives; bio-polymer molecules such as poly-L-lactic acids and their derivatives, and membrane proteins, as well as phosphate bio-molecules; polyanilines and their derivatives, and all of the derivatives of tetramines; polyimides, including Kapton molecules and polyetherimide ("PEI"), and their derivatives; all of the membrane polymers; poly(N-vinyl pyrrolidone) ("PVP") homopolymer, and its derivatives, and random PVP-co-vinyl acetate ("PVAc") copolymers; and all of the aromatic polymers with dipole moment groups in the main-chain or side-chains, or in both the main-chain and the side-chains, and mixtures thereof.

Further, piezoelectric materials can include Pt, Pd, Ni, T, Cr, Fe, Ag, Au, Cu, and metal alloys and mixtures thereof. These piezoelectric materials can also include, for example, metal oxide such as $SiO_2$, $Al_2O_3$, $ZrO_2$, $TiO_2$, $SrTiO_3$, $PbTiO_3$, $BaTiO_3$, $FeO_3$, $Fe_3O_4$, ZnO, and mixtures thereof; and Group VIA and IIB compounds, such as CdSe, CdS, GaAs, $AgCaSe_2$, ZnSe, GaP, InP, ZnS and mixtures thereof.

MR Elastomers: Suitable active materials also comprise magnetorheological (MR) compositions, such as MR elastomers, a class of smart materials whose rheological properties can rapidly change upon application of a magnetic filed. MR elastomers are suspensions of micrometer-sized, magnetically polarizable particles in a thermoset elastic polymer or rubber. The stiffness of the elastomer structure is accomplished by changing the shear and compression/tension moduli by varying the strength of the applied magnetic field. The MR elastomers typically develop their structure when exposed to a magnetic field in as little as a few milliseconds. Discontinuing the exposure of the MR elastomers to the magnetic field reverses the process and the elastomer returns to its lower modulus state. Suitable MR elastomer materials include, but are not intended to be limited to, an elastic polymer matrix comprising a suspension of ferromagnetic or paramagnetic particles, wherein the particles are described above. Suitable polymer matrices include, but are not limited to, poly-alpha-olefins, natural rubber, silicone, polybutadiene, polyethylene, polyisoprene, and the like.

MSMA: MSMAs are alloys, often composed of Ni—Mn—Ga, that change shape due to strain induced by a magnetic field. MSMAs have internal variants with different magnetic and crystallographic orientations. In a magnetic field, the proportions of these variants change, resulting in an overall shape change of the material. An MSMA actuator generally requires that the MSMA material be placed between coils of an electromagnet. Electric current running through the coil induces a magnetic field through the MSMA material, causing a change in shape.

In the latch assembly 10 shown in FIGS. 1-3, the active material based actuator 28 is an SMA wire. Other geometric forms of SMA may be used, such as, without limitation: a cable, multiple wires in parallel, a strip, a rod, or another shape recognized by those having ordinary skill in the art as capable of moving the second lever 24 from the locked to the unlocked position.

The activation signal for the active material based actuator 28 occurs via an electrical current passing through the active material based actuator 28. Upon application of the activation signal, the active material based actuator 28 contracts, causing the second lever 24 to rotate counterclockwise (as viewed in FIGS. 1-3) and move from the locked to the unlocked position. This movement of the second lever 24 allows movement of the first lever 16 and latch 12, which are then able to move into the open position and released position, respectively.

Due to the utilization of both the first lever 16 and the second lever 24, the overall movement (or total rotation) of the second lever 24 is relatively small compared to the movement of the latch 12. This reduction in travel reduces the amount of contraction required of the SMA wire used as the base of active material actuator 28. Furthermore, the force applied by the active material based actuator 28 on the second lever 24 is reduced because the second lever 24 does not act directly on the latch 12, and the second lever 24 is, therefore, not required to counteract the mass of the hood in the same way as the latch 12.

In the latch assembly 10 shown in FIGS. 1-3, the second lever 24 rotates from the locked to the unlocked position. This rotation, as opposed to translational movement, further increases the mechanical advantage of the latch assembly 10 and reduces the total distance/contraction of the active material based actuator 28.

The reduction in work required by the active material based actuator 28—through both the reduced force needs and distance requirements—allows the use of smaller actuators. For example, the SMA wire can be reduced in both cross-section and length because of the two-lever latch assembly 10. Depending upon the specific type of active material (or SMA wire) used, the reduced length and cross-section may yield improved weight and assembly characteristics.

Those having ordinary skill in the art will recognize that the path of the active material based actuator 28 shown in FIGS. 1-3 is illustrative only, and the active material based actuator 28 may be oriented or routed differently to better effect movement of the second lever 24. The illustrative location of active material based actuator 28 represents one location and orientation capable of causing movement of the second lever 24 when the SMA wire contracts.

The activation signal is selectively produced by a primary activation mechanism 30 which is operatively connected to a power system 32 of the vehicle and operatively connected to the active material based actuator 28. Where the activation signal is an electric current, primary activation mechanism 30 selectively subjects active material based actuator 28 to a voltage differential, causing electric current to flow through the active material based actuator 28. Primary activation mechanism 30 operates with power or energy derived from the vehicle power system 32, and therefore does not operate when the power system 32 is not operating.

The active material based actuator 28 may complete its own circuit by running or looping from the housing to second lever 24 and back, or the second lever 24 may be configured to complete the circuit. In the latch assembly 10 shown in FIGS. 1-3, the current causes a temperature increase in the SMA wire, which triggers a phase change in the SMA and causes contraction of the active material based actuator 28.

The latch assembly 10 further includes a trigger device 34 operatively connected to the primary activation mechanism 30. The trigger device 34 is configured to cause the primary activation mechanism 30 to produce the activation signal. Trigger device 34 may be a push button, switch, or similar structure mounted within the passenger compartment of the vehicle. However, the trigger device 34 is characterized by lack of a mechanical connection to the passenger compartment of the vehicle. Therefore, no mechanical cable links the primary activation mechanism 30 or the latch assembly 10 to the passenger compartment, and the operator is not required to pull a cable or handle.

As shown in FIGS. 1-3, the latch assembly 10 further includes an auxiliary activation mechanism 40. Like the primary activation mechanism 30, the auxiliary activation mechanism 40 is configured to selectively move the second lever 24 from the locked position to the unlocked position. However, the auxiliary activation mechanism 40 does not rely on the power system 32 in order to effect movement of the second lever 24, and is therefore capable of releasing the hood even while the power system 32 is not operating or is inoperable.

The auxiliary activation mechanism 40 may include a dedicated energy storage device 44, such as a chemical electric storage battery, but capacitive devices or other energy storage devices may also be utilized. The dedicated energy storage device 44 is configured to selectively produce the activation signal and cause the active material based actuator 28 to contract, rotating the second lever 24 counterclockwise (as viewed in FIGS. 1-3) from the locked to the unlocked position. The dedicated energy storage device 44 may be intermittently charged by elements of the power system 32. However, the dedicated energy storage device 44 is not permanently connected to, and operates independently of, the vehicle power system 32, and therefore works during outages of the vehicle power system 32.

The auxiliary activation mechanism 40 may include a key (not individually shown) operatively connectable or matable to the auxiliary activation mechanism 40 through a port 46. The key and port 46 are configured to cause the auxiliary activation mechanism 40 to produce the activation signal. The port 46 may be located, for example, on or next to the hood, behind the vehicle's grille, under or next to one of the vehicle's wheel wells, or in another area accessible without opening the hood.

The key may cause the activation signal by, for example, causing the dedicated energy storage device 44 to connect to the circuit of the active material based actuator 28, such as by shorting the circuit with the dedicated energy storage device 44. In this way, the latch assembly 10 could be opened and the hood released while the power supply 32 is either not operating or has insufficient power to actuate the active material based actuator 28. In some latch assembly designs, the key may itself be a portable energy storage device. The key would then be configured to, when inserted into port 46, produce the activation signal with its own stored energy.

The auxiliary activation mechanism 40 may also include an electrical "pigtail" connection that allows a portable energy storage device or other external power supply to be connected to it. The external power supply would be configured for supplying the necessary power to release the latch by signaling the active material based actuator 28 and moving the second lever 24. For example, the external power supply may be a 12-volt backup power supply used by automobile dealers and repair or maintenance facilities to charge the vehicle power supply 32. Those having ordinary skill in the art will recognize that neither the vehicle power supply 32 nor attachable external power supply must be based upon a 12-volt system, as long as the functional ability to attach an external power source to activate the latch assembly 10 is maintained.

When the key is included, the latch assembly 10 may be configured without the trigger device 34 operatively connected to the primary activation mechanism 30 via the passenger compartment. The key itself may be a portable trigger mechanism, and may, therefore, be used as the sole trigger for causing either the primary activation mechanism 30 or the auxiliary activation mechanism 40 to produce the activation signal.

Alternatively, the auxiliary activation mechanism 40 may include a mechanical actuator or linkage. For example, the port 46 may be a rotatable hub attached to a cable 48 which is operatively attached to the second lever 24. When the cable 48 is mechanically retracted by, for example, rotating the port 46 with the key or wrench-like device, the second lever 24 will move from the locked position to the unlocked position, without actuating the active material based actuator 28.

Figure 4:
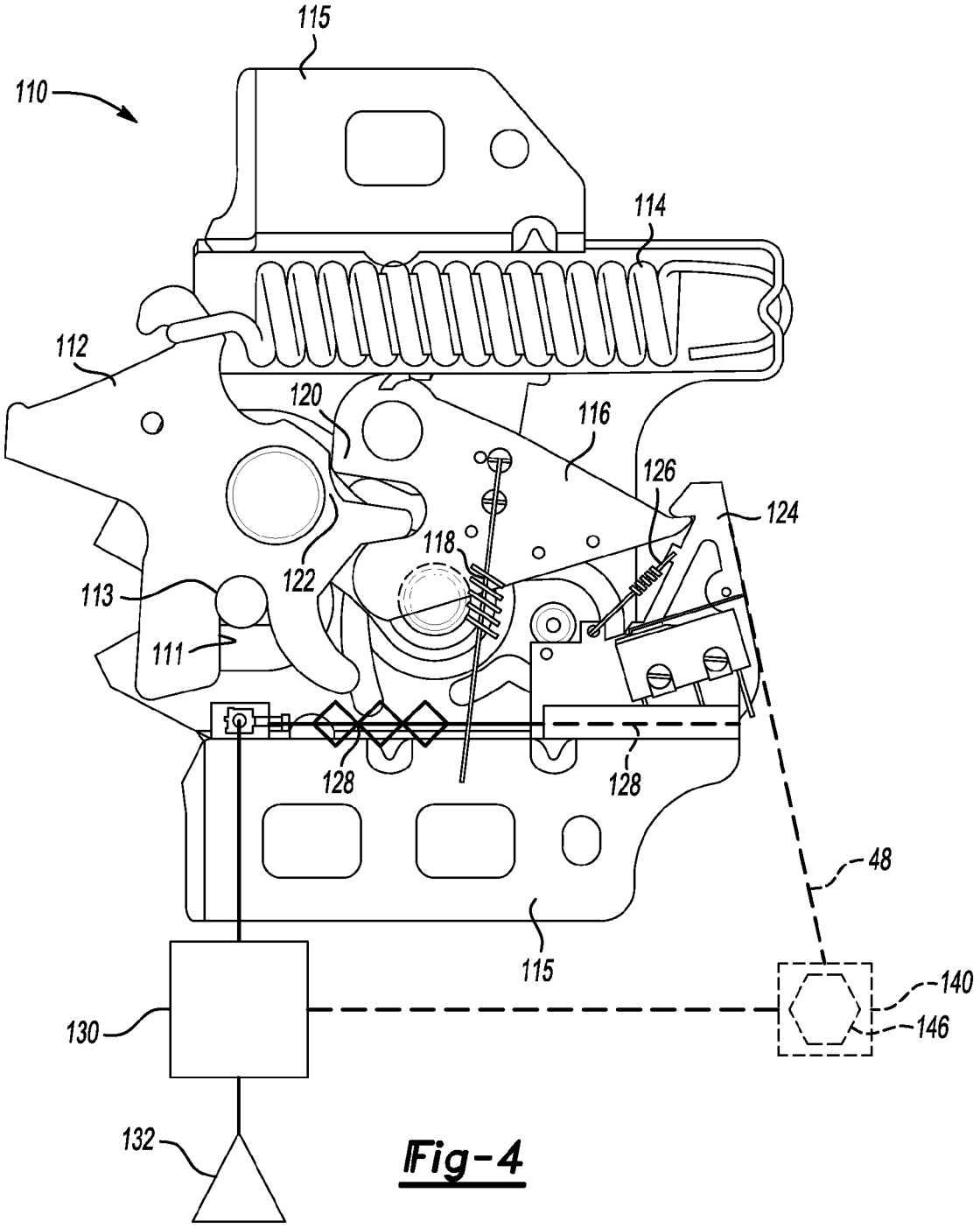
FIG. 4 is a schematic side view of a latch assembly usable as a hood release, shown in a locked position.
Figure 5:
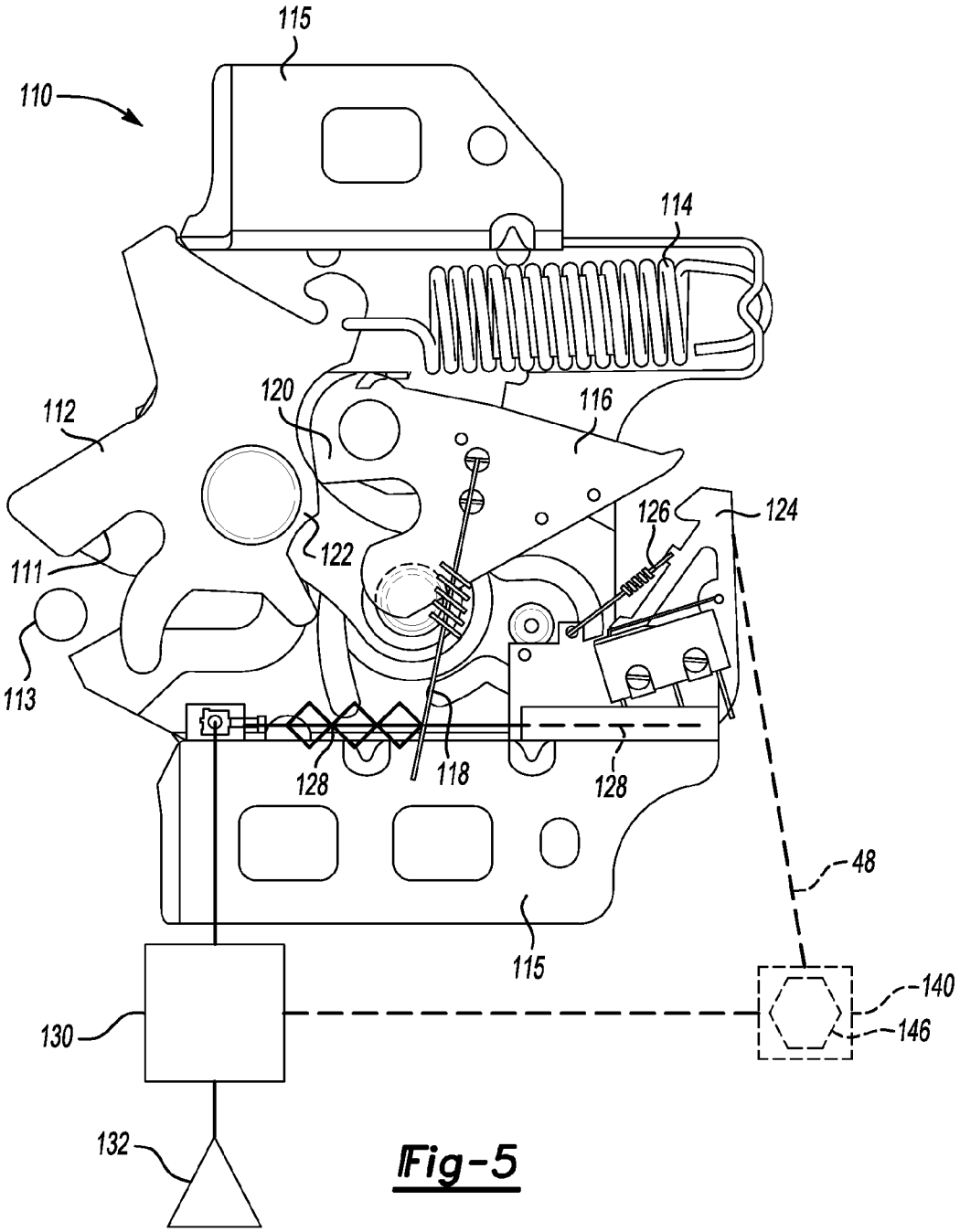
FIG. 5 is a schematic side view of the latch assembly shown in FIG. 4, showing the latch assembly in a fully-released position.

FIGS. 4 and 5 show a latch assembly 110 which may be used as a hood latch configured to selectively hold and release a hood, cowling, or bonnet (not shown) of the vehicle. FIG. 4 shows the latch assembly 110 in a completely restrained position which prevents movement of the hood. FIG. 5 shows the latch assembly 110 in a released or open position, in which the hood is free to be raised away from the vehicle. The operation of latch assembly 110 is similar in concept and application to the latch assembly 10 shown in FIGS. 1-3.

A latch 112 has a slot or gate 111 which is configured to restrain movement of a striker bar 113 which is rigidly attached to the hood. Latch 112 is movable between a released position and a restrained position. The restrained position is shown in FIG. 4 and represents complete restraint of the striker bar 113, such that the hood is securely pulled to the vehicle and cannot be opened. The released position of latch 112 may be considered to encompass all positions, rotations, or movements beyond the restrained position. FIG. 5 shows latch 112 in the released position, such that the striker bar 113 is free to be removed from the gate 111 (upward, as shown in FIG. 5).

A latch spring 114 is operatively attached to the latch 112 and to a housing 115 which is rigidly attached or affixed to the vehicle. Latch spring 114 is configured to bias the latch 112 toward the released position (a bias in the clockwise direction, as shown in FIGS. 4 and 5). In the latch assembly 110 shown in FIGS. 4 and 5, latch spring 114 is a linear, tension spring. However, a torsion spring may also be used.

A first lever 116 is mounted with respect to the latch 112 and movable between an open position and a closed position. The closed position of first lever 116 is shown in FIG. 4 and the open position is shown in FIG. 5.

A first lever spring 118 is operatively attached to the first lever 116 and to the housing 115. First lever spring 118 is configured to bias the first lever 116 toward the closed position (clockwise, as shown in FIGS. 4 and 5). In the latch assembly 110 shown in FIGS. 4 and 5, first lever spring 118 is a linear, tension spring. However, a torsion spring may also be used.

First lever 116 interfaces with latch 112 to limit relative movement between latch 112 and first lever 116. The released position of the latch 112 corresponds to the open position of first lever 116, and the restrained position of the latch 112 corresponds to the closed position of first lever 116.

First lever 116 includes first cam portion 120 and the latch 112 includes a second cam portion 122. The first and second cam portions 120 and 122 cooperate to prevent movement of the first lever 116 into the closed position unless the latch 112 is fully in the restrained position. The first and second cam portions 120 and 122 also provide a friction interface between the latch 112 and first lever 116, which limits or restricts relative movement of the latch 112 and first lever 116. The friction between the first and second cam portions 120 and 122 may be tuned to control the force required to move the latch 112 from the restrained to the released position.

A second lever 124 is mounted with respect to the first lever and movable between an unlocked and a locked position. The locked position of the second lever 124 is shown in FIG. 4 and the unlocked position is shown in FIG. 5.

Second lever 124 interfaces with first lever 116 to limit relative movement between second lever 124 and first lever 116. The unlocked position of second lever 124 corresponds to the open position of first lever 116, and the locked position of second lever 124 corresponds to the closed position of first lever 116.

A second lever spring 126 is operatively attached to the second lever 124 and to the housing 115. Second lever spring 126 is configured to bias the second lever 124 toward the locked position (counterclockwise, as shown in FIGS. 4 and 5). In the latch assembly 110 shown in FIGS. 4 and 5, second lever spring 26 is a linear tension spring. However, a torsion spring may also be used.

Operation of latch assembly 110 is effected by an active material based actuator 128, which is operatively connected to the second lever 124 and to the housing 115 (the connection between active material based actuator 128 and second lever 124 is hidden from view in FIGS. 4 and 5 by a portion of housing 115). The active material based actuator 128 is configured to selectively move the second lever 124 from the locked position to the unlocked position in the presence of an activation signal, as described herein.

In the latch assembly 110 shown in FIGS. 4 and 5, the active material based actuator 128 is an SMA wire. Other geometric forms of SMA may be used, such as, without limitation: a cable, multiple wires in parallel, a strip, a rod, or another shape recognized by those having ordinary skill in the art as capable of moving or rotating the second lever 124 from the locked to the unlocked position.

The activation signal for the active material based actuator 128 is an electrical current passing through the active material based actuator 128. Upon application of the activation signal, the active material based actuator 128 contracts, causing the second lever 124 to rotate clockwise (as viewed in FIGS. 4 and 5) and move from the locked to the unlocked position. This movement of the second lever 124 allows movement of the first lever 116 and latch 112, which are then able to move into the open position and released position, respectively.

Those having ordinary skill in the art will recognize that the path of the active material based actuator 128 shown in FIGS. 4 and 5 is illustrative only, and the active material based actuator 128 may be oriented or routed differently to better effect movement of the second lever 124. For example, the active material based actuator 128 may be oriented vertically (as viewed in FIGS. 4 and 5), or placed at an angle to the second lever 124. The path and orientation of the active material based actuator 128 may affect the mechanical advantage of the active material based actuator 128 as it acts to move the second lever 124.

The activation signal is selectively produced by a primary activation mechanism 130 which is operatively connected to a power system 132 of the vehicle and operatively connected to the active material based actuator 128. Where the activation signal is an electric current, primary activation mechanism 130 selectively subjects active material based actuator 128 to a voltage differential, causing electric current flow through the active material based actuator 128. Primary activation mechanism 130 operates with power or energy derived from the vehicle power system 132, and therefore does not operate when the power system 132 is drained or otherwise not operating.

The latch assembly 110 may also include a trigger device (not shown) operatively connected to the primary activation mechanism 130. The trigger device is configured to cause the primary activation mechanism 130 to produce the activation signal. The latch assembly 110 is characterized by lack of a mechanical connection to the passenger compartment of the vehicle; and, therefore, no mechanical cable links the primary activation mechanism 30 to the passenger compartment.

As shown in FIGS. 4 and 5 the latch assembly 110 further includes an auxiliary activation mechanism 140, which is configured to selectively move the second lever 124 from the locked position to the unlocked position. However, the auxiliary activation mechanism 140 does not rely on the power system 132 in order to effect movement of the second lever 124, and is therefore capable of releasing the hood while the power system 132 is not operating or is inoperable.

The auxiliary activation mechanism 140 may include a dedicated energy storage device (not shown), such as a chemical electric storage battery, but capacitive devices or other energy storage devices may also be utilized. The dedicated energy storage device is configured to selectively produce the activation signal and actuate the active material based actuator 128.

The auxiliary activation mechanism 140 may also include a key (not individually shown) operatively connectable or matable to the auxiliary activation mechanism 140 through a port 146. The key and port 146 are configured to cause the auxiliary activation mechanism 140 to produce the activation signal. The port 146 may be located, for example, on or next to the hood, behind the vehicle's grille, or in another area accessible without opening the hood.

The key may cause the activation signal by causing the dedicated energy storage device to connect to the circuit of active material based actuator 128. In this way, the latch assembly 110 could be opened and the hood released while the power supply 132 is not operating or has insufficient power to actuate the active material based actuator 128.

In one design or configuration, the key may itself be a portable energy storage device. The key would then be configured to, when inserted into port 146, produce the activation signal with its own stored energy. The auxiliary activation mechanism 140 may include an electrical "pigtail" connection that allows the portable energy storage device or another external power supply to be connected to it. The external power supply would therefore supply the necessary power to generate the activation signal and release the latch by moving the second lever 124.

In the latch assembly 110 shown in FIGS. 4 and 5, auxiliary activation mechanism 140 connects to the primary activation mechanism 130, and the key may be used to trigger either the primary activation mechanism 130 or auxiliary activation mechanism 140. As such, the key may be used as the sole trigger for causing the primary activation mechanism 130 and the auxiliary activation mechanism 140 to produce the activation signal.

In the latch assembly 110 shown in FIGS. 4 and 5, the auxiliary activation mechanism 140 includes a mechanical actuator or linkage operatively attached to the port 146. Insertion of the key or a tool configured to provide torque allows the cable 48 to be mechanically retracted, which causes the second lever 124 to move from the locked position to the unlocked position.

Figure 6:
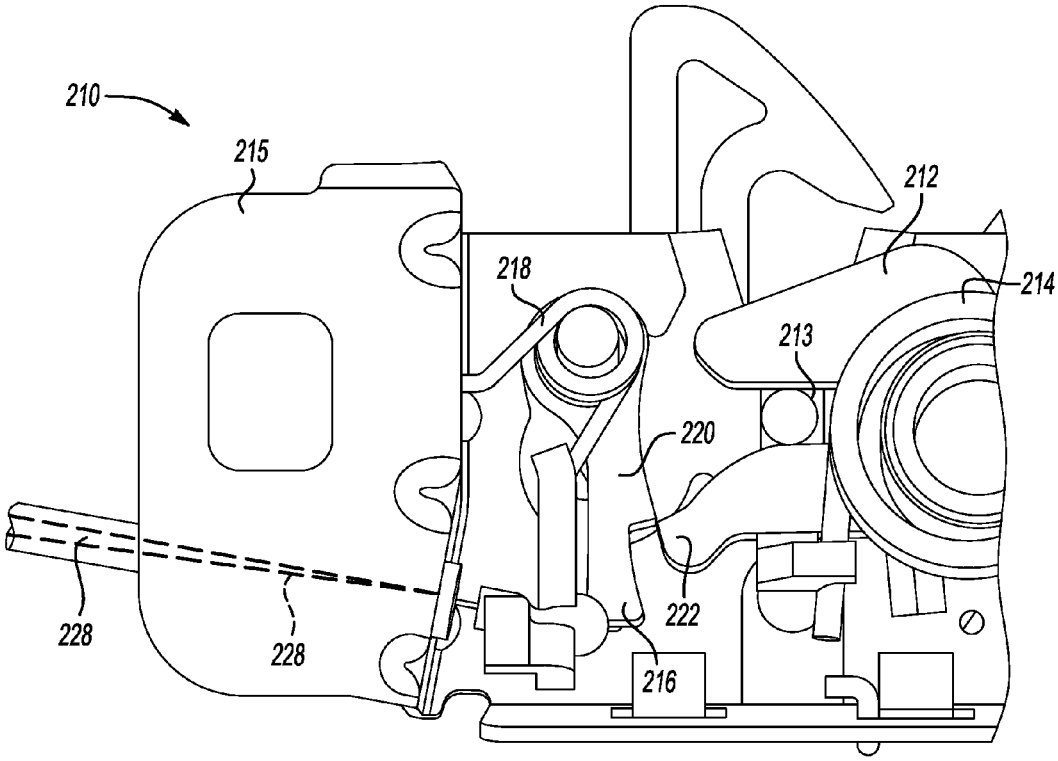
FIG. 6 is a schematic side view of a latch assembly which utilizes a single lever and is shown in a locked position.
Figure 7:
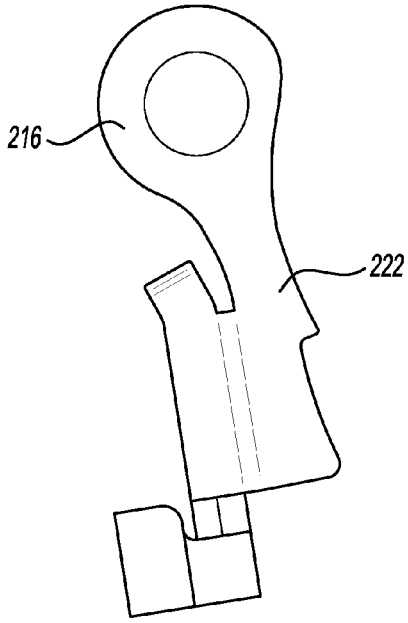
FIG. 7 is a schematic side view of the first lever of the latch assembly shown in FIG. 6, detailing the cam portion of the lever.

FIGS. 6 and 7 show a latch assembly 210 which may be used as a hood latch configured to selectively hold and release a hood, cowling, or bonnet (not shown) of the vehicle. The latch assembly 210 is a single-lever structure, utilizing only a first lever 216 to open and close the latch assembly 210. FIG. 6 shows the latch assembly 210 in a completely restrained or closed position. FIG. 7 shows a more-detailed schematic view of the first lever 216.

A latch 212 is configured to restrain movement of a striker bar 213 which is rigidly attached to the hood. Latch 212 is movable between a released position and a restrained position. The restrained position is shown in FIG. 6 and represents complete restraint of the striker bar 213, such that the hood is securely pulled to the vehicle and cannot be opened. The released position of latch 212 may be considered to encompass all positions, rotations, or movements beyond the restrained position. Latch assembly 210 is not specifically shown in the released position, but the striker bar 213 would be freed to be removed from the gate (upward, as shown in FIG. 6), in a similar manner to the structures and positions depicted in FIGS. 3 and 5.

A latch spring 214 is operatively attached to the latch 212 and to a housing 215 which is rigidly attached or affixed to the vehicle. Latch spring 214 is configured to bias the latch 212 toward the released position (clockwise, as shown in FIG. 6). In the latch assembly 210 shown in FIG. 6, latch spring 214 is a torsion spring.

The first lever 216 is mounted with respect to the latch 212 and movable between an open position and a closed position, as shown in FIG. 6. A first lever spring 218 is operatively attached to the first lever 216 and to the housing 215. First lever spring 218 is configured to bias the first lever 216 toward the closed position (counterclockwise, as shown in FIG. 6). In the latch assembly 210 shown in FIG. 6, first lever spring 218 is a torsion spring.

First lever 216 interfaces with latch 212 to limit relative movement between latch 212 and first lever 216. The released position of the latch 212 corresponds to the open position of first lever 216, and the restrained position of the latch 212 corresponds to the closed position of first lever 216.

First lever 216 includes a first cam portion 220 and the latch 212 includes a second cam portion 222. The first and second cam portions 220 and 222 cooperate to prevent movement of the first lever 216 into the closed position unless the latch 212 is fully in the restrained position. The first and second cam portions 220 and 222 also provide a friction interface between the latch 212 and first lever 216, which inhibits relative movement of the latch 212 and first lever 216. The friction between the first and second cam portions 220 and 222 may be tuned to control the force required to move the latch 212 from the restrained to the released position.

Operation of latch assembly 210 is effected by an active material based actuator 228, which is operatively connected to the first lever 218 and to the housing 215. The active material based actuator 228 is configured to selectively move the first lever 218 from the closed position to the open position in the presence of an activation signal, as described herein. The active material based actuator 228 may be an SMA wire and other geometric forms of SMA may be used to move the first lever 218 from the closed position to the open position.

The activation signal for the active material based actuator 228 is an electrical current passing through the active material based actuator 228. Upon application of the activation signal, the active material based actuator 228 contracts, causing the first lever 216 to rotate clockwise (as viewed in FIG. 6) and move from the closed to the open position. This movement of the first lever 216, alone, allows movement of the latch 212, which is then able to move into the released position.

The activation signal is selectively produced by either a primary or auxiliary activation mechanism (not shown), which may be similar to those described above. Where the activation signal is an electric current, the activation mechanism selectively subjects active material based actuator 228 to a voltage differential, causing electric current flow through the active material based actuator 228. As shown in FIG. 6, the active material based actuator 228 has either two separate wires joining at first lever 216 or a single wire looped at first lever 216 to form a complete circuit when subjected to the activation signal at the other end of the active material based actuator 228. The SMA wires shown are encased in a protective tube and may be further encased in individual protective covers or tubes to prevent the two wires from contacting each other.

While the present invention is described in detail with respect to automotive applications, those skilled in the art will recognize the broader applicability of the invention. Those having ordinary skill in the art will recognize that terms such as "above," "below," "upward," "downward," et cetera, are used descriptively of the figures, and do not represent limitations on the scope of the invention, as defined by the appended claims.

While the best modes and other modes for carrying out the claimed invention have been described in detail, those familiar with the art to which this invention relates will recognize various alternative designs and embodiments for practicing the invention within the scope of the appended claims.

The invention claimed is:

1. A latch assembly for a vehicle, the latch assembly comprising:

one or more housing members configured to be fixedly attached to the vehicle;

a latch movable between a released position and a restrained position;

a latch spring operatively attached to said latch and configured to bias said latch toward said released position;

a first lever mounted to the one or more housing members with respect to said latch, said first lever movable between an open position and a closed position, wherein said released position of said latch corresponds to said open position of said first lever and said restrained position of said latch corresponds to said closed position of said first lever and said closed position of said first lever does not allow said latch to move from said released position to said restrained position;

a first lever spring operatively attached to said first lever and configured to bias said first lever toward said closed position;

a second lever mounted to the one or more housing members with respect to said first lever and movable between an unlocked and a locked position, wherein said unlocked position of said second lever corresponds to said open position of said first lever and said locked position of said second lever corresponds to said closed position of said first lever;

a second lever spring operatively attached to said second lever and configured to bias said second lever toward said locked position;

a shape memory material based actuator operatively connected to said second lever and configured to selectively move said second lever from said locked position to said unlocked position in the presence of an activation signal; and a primary activation mechanism operatively connected to a power system of the vehicle and configured to selectively produce said activation signal.

2. The latch assembly of claim 1, further comprising an auxiliary activation mechanism configured to selectively move said second lever from said locked position to said unlocked position, wherein said auxiliary activation mechanism is characterized by a lack of reliance on said power system of the vehicle.

3. The latch assembly of claim 2, further comprising a trigger device operatively connected to said primary activation mechanism and configured to cause said primary activation mechanism to produce said activation signal, wherein said trigger device is characterized by lack of a mechanical connection to a passenger compartment of the vehicle.

4. The latch assembly of claim 3, wherein said activation signal is an electrical current passing through said shape memory material based actuator.

5. The latch assembly of claim 4, wherein said shape memory material based actuator is a shape memory alloy wire.

6. The latch assembly of claim 4, wherein said shape memory material based actuator is an electroactive polymer.

7. The latch assembly of claim 5, wherein said auxiliary activation mechanism includes a dedicated energy storage device configured to selectively produce said activation signal.

8. The latch assembly of claim 7, further comprising a key operatively connectable to said auxiliary activation mechanism and configured to cause said auxiliary activation mechanism to produce said activation signal.

9. The latch assembly of claim 8, wherein said key further includes a portable energy storage device configured to selectively produce said activation signal.

10. The latch assembly of claim 5, wherein said auxiliary activation mechanism is a mechanical actuator configured to selectively mechanically move said second lever from said locked position to said unlocked position.

11. The latch assembly of claim 5, further comprising:

a first cam portion on said first lever; and a second cam portion on said latch, wherein said first and second cam portions cooperate to prevent movement of said first lever into said closed position unless said latch is fully in said restrained position.

12. The latch assembly of claim 2, further comprising a portable trigger mechanism configured to cause one of said primary activation mechanism and said auxiliary activation mechanism to produce said activation signal, wherein said portable trigger mechanism is not fixed to a passenger compartment of the vehicle, and wherein said portable trigger mechanism is the only mechanism configured to cause said activation signal and to move said second lever from said locked position to said unlocked position.

13. The latch assembly of claim 5, wherein said auxiliary activation mechanism includes a wire connector configured to allow an external power source to be connected to said auxiliary activation mechanism to selectively produce said activation signal.

14. The latch assembly of claim 4, wherein said shape memory material based actuator is formed from a shape memory alloy.

15. A latch assembly for a vehicle, the latch assembly comprising:

one or more housing members configured to be fixedly attached to the vehicle;

a latch movable between a released position and a restrained position;

a latch spring operatively attached to said latch and configured to bias said latch toward said released position;

a first lever mounted to the one or more housing members with respect to said latch, said first lever movable between an open position and a closed position, wherein said released position of said latch corresponds to said open position of said first lever and said restrained position of said latch corresponds to said closed position of said first lever and said closed position of said first lever does not allow said latch to move from said released position to said restrained position;

a first lever spring operatively attached to said first lever and configured to bias said first lever toward said closed position;

a second lever mounted to the one or more housing members with respect to said first lever and movable between an unlocked and a locked position, wherein said unlocked position of said second lever corresponds to said open position of said first lever and said locked position of said second lever prevents movement of said first lever from said closed position to said open position;

a second lever spring operatively attached to said second lever and configured to bias said second lever toward said locked position;

a shape memory material based actuator operatively connected to said second lever and configured to selectively move said second lever from said locked position to said unlocked position in the presence of an activation signal; and a primary activation mechanism operatively connected to a power system of the vehicle and configured to selectively produce said activation signal.

16. The latch assembly of claim 15, further comprising:

an auxiliary activation mechanism configured to selectively move said second lever from said locked position to said unlocked position, wherein said auxiliary activation mechanism is not connected to said power system of the vehicle.

17. The latch assembly of claim 16, further comprising:

a port operatively connected to said auxiliary activation mechanism; and a key insertable into said port, such that said key is configured to cause said auxiliary activation mechanism to produce said activation signal when inserted into said port.

18. The latch assembly of claim 17, wherein said key further includes a portable energy storage device, and said portable energy storage device is configured to selectively produce said activation signal with its own stored energy when said key is inserted into said port.

* * * * *